US009725215B2

(12) United States Patent
Hsieh

(10) Patent No.: US 9,725,215 B2
(45) Date of Patent: Aug. 8, 2017

(54) CONTAINER THAT PREVENTS ILLEGAL OPERATION AND CAN BE EASILY IDENTIFIED AFTER BEING ILLEGALLY OPERATED

(71) Applicant: Albert Hsieh, Lukang Township, Changhua County (TW)

(72) Inventor: Albert Hsieh, Lukang Township, Changhua County (TW)

(73) Assignee: VIGOURPLASTIC CO., LTD., Lukang Township, Changhua County (TW)

( * ) Notice: Subject to any disclaimer, the term of this patent is extended or adjusted under 35 U.S.C. 154(b) by 0 days.

(21) Appl. No.: 14/722,646

(22) Filed: May 27, 2015

(65) Prior Publication Data

US 2016/0347515 A1 Dec. 1, 2016

(51) Int. Cl.
*B65D 43/02* (2006.01)

(52) U.S. Cl.
CPC ..... *B65D 43/0272* (2013.01); *B65D 2543/00092* (2013.01); *B65D 2543/00101* (2013.01); *B65D 2543/00296* (2013.01); *B65D 2543/00351* (2013.01); *B65D 2543/00509* (2013.01); *B65D 2543/00842* (2013.01)

(58) Field of Classification Search
CPC ..... B65D 43/0272; B65D 2543/005; B65D 2543/00351; B65D 2543/00842; B65D 2543/00092; B65D 2543/00101; B65D 2543/00296
USPC ..... 220/270, 791, 789
See application file for complete search history.

(56) References Cited

U.S. PATENT DOCUMENTS 8,272,526 B1 * 9/2012 Vovan ..... B65D 43/0254 215/253
2015/0028033 A1 * 1/2015 Samuel ..... B65D 43/0266 220/270

* cited by examiner

*Primary Examiner* — James N Smalley
(74) *Attorney, Agent, or Firm* — Egbert Law Offices, PLLC

(57) ABSTRACT

A container includes a containing structure defining an opening and an annular lip radially extending from a distal edge of the opening. A cover is selectively and water-tightly closing the opening. The cover includes a annular rib formed on a bottom thereof and a flange radially extending therefrom wherein the flange abuts against the annular lip when the cover water-tightly closing the opening. A tongue extends from the flange and a pre-broken line is formed on the tongue, wherein the pre-broken line encircles a pre-broken portion and a stopper is formed on a bottom of the pre-broken portion. The tongue forms a griphook for user to easily detach the cover from the containing structure when the pre-broken portion is detached from the tongue along the pre-broken line.

3 Claims, 10 Drawing Sheets

CONTAINER THAT PREVENTS ILLEGAL OPERATION AND CAN BE EASILY IDENTIFIED AFTER BEING ILLEGALLY OPERATED

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates to a container, and more particularly to a container that prevents an illegal operation and can be easily identified after being illegally operated.

2. Description of Related Art Including Information Disclosed Under 37 CFR 1.97 and 37 CFR 1.98

Vacuum-formed plastic containers are usually made to have a box-shaped or a cup-shaped containing structure and are used in supermarkets for keeping food fresh. The plastic container is transparent for the buyer to clearly see the contents, such as jelly-like, fruit or liquid foods and provided to stimulate customer's buying intent. For containing liquid foods, the conventional plastic containers focus on the function of a water-tightly seal. The conventional plastic container usually includes a hollow body and a body for selectively closing the hollow body.

The conventional plastic containers are provided for containing instant foods. However, the conventional plastic container provides no function to stop an illegal operation. The tamper-resistant/evident structures very important for deterring theft and preventing the loss of product and income for the seller, as well as instilling consumer confidence in the integrity of the contents within the container and confidence in the ability of the seller and/or manufacturer to provide and maintain quality goods.

The present invention has arisen to mitigate and/or obviate the disadvantages of the conventional container used in the supermarket for containing fresh foods.

BRIEF SUMMARY OF THE INVENTION

The main objective of the present invention is to provide an improved container that prevents an illegal operation and can be easily identified after being illegally operated.

To achieve the objective, a container in accordance with the present invention comprises a containing structure defining an opening for inputting objects therein and having an annular lip radially extending from a distal edge of the opening. A cover is selectively water-tightly mounted on to the containing structure for closing the containing structure.

The cover includes an annular rib formed on a bottom thereof and a flange radially extending from the periphery of the cover, wherein the flange has an outer diameter smaller than that of the annular lip and a width smaller than a human's fingertip. The annular rib is water-tightly and partially received in the opening and the flange abuts against the annular lip when the cover water-tightly closes the opening of the containing structure when the cover closes the containing structure. A tongue extends from the flange and a pre-broken line is formed on the tongue, wherein the pre-broken line encircles a pre-broken portion and a stopper is formed on a bottom of the pre-broken portion. The pre-broken portion partially abuts against the annular lip and the stopper is disposed along a distal edge of the annular lip. The tongue forms a griphook for user to easily detach the cover from the containing structure when the pre-broken portion is detached from the tongue along the pre-broken line.

Further benefits and advantages of the present invention will become apparent after a careful reading of the detailed description with appropriate reference to the accompanying drawings.

DETAILED DESCRIPTION OF THE INVENTION

Figure 1:
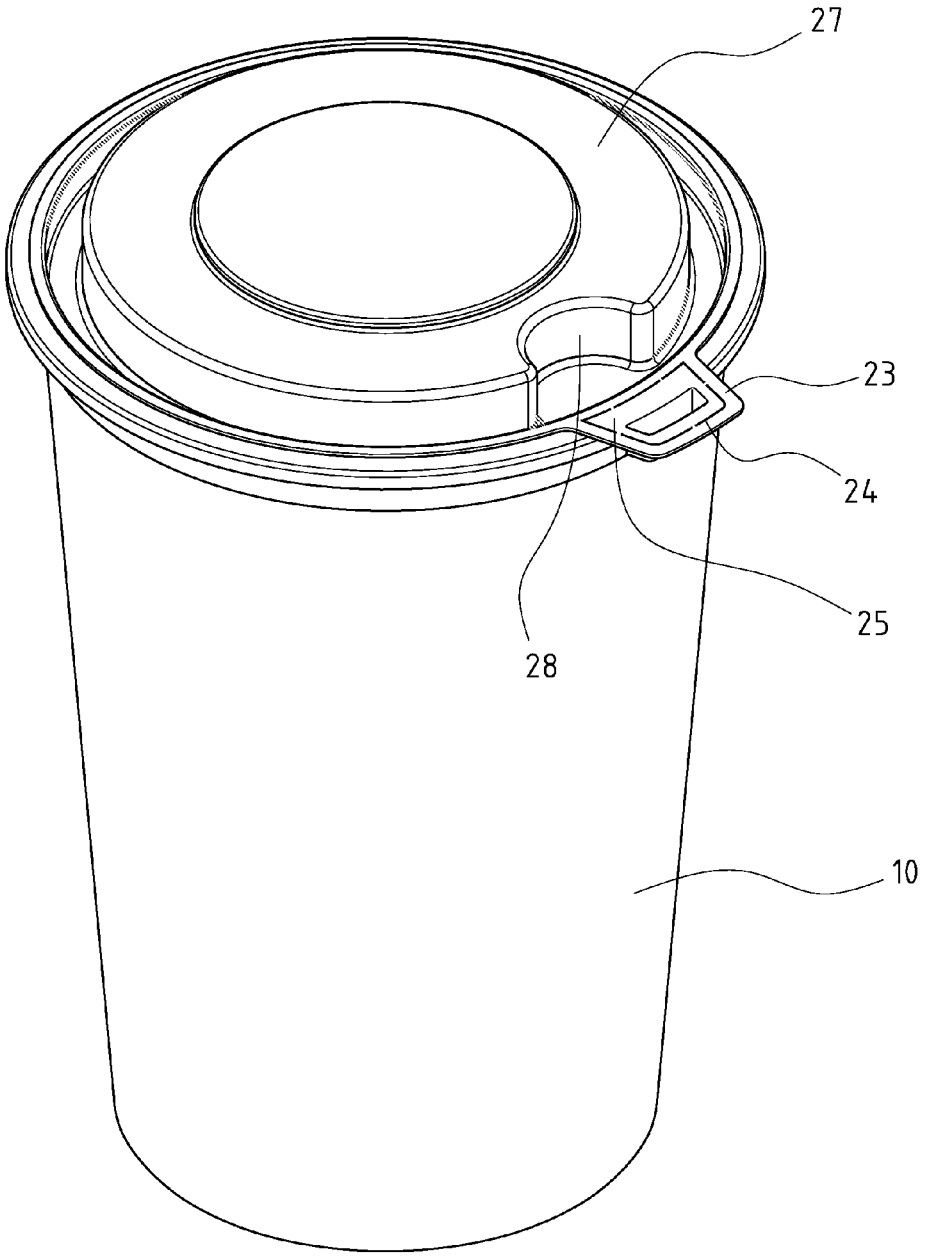
FIG. 1 is a perspective view of a container that prevents from an illegal operation and can be easily identified after being illegally operated in accordance with the present invention.
Figure 2:
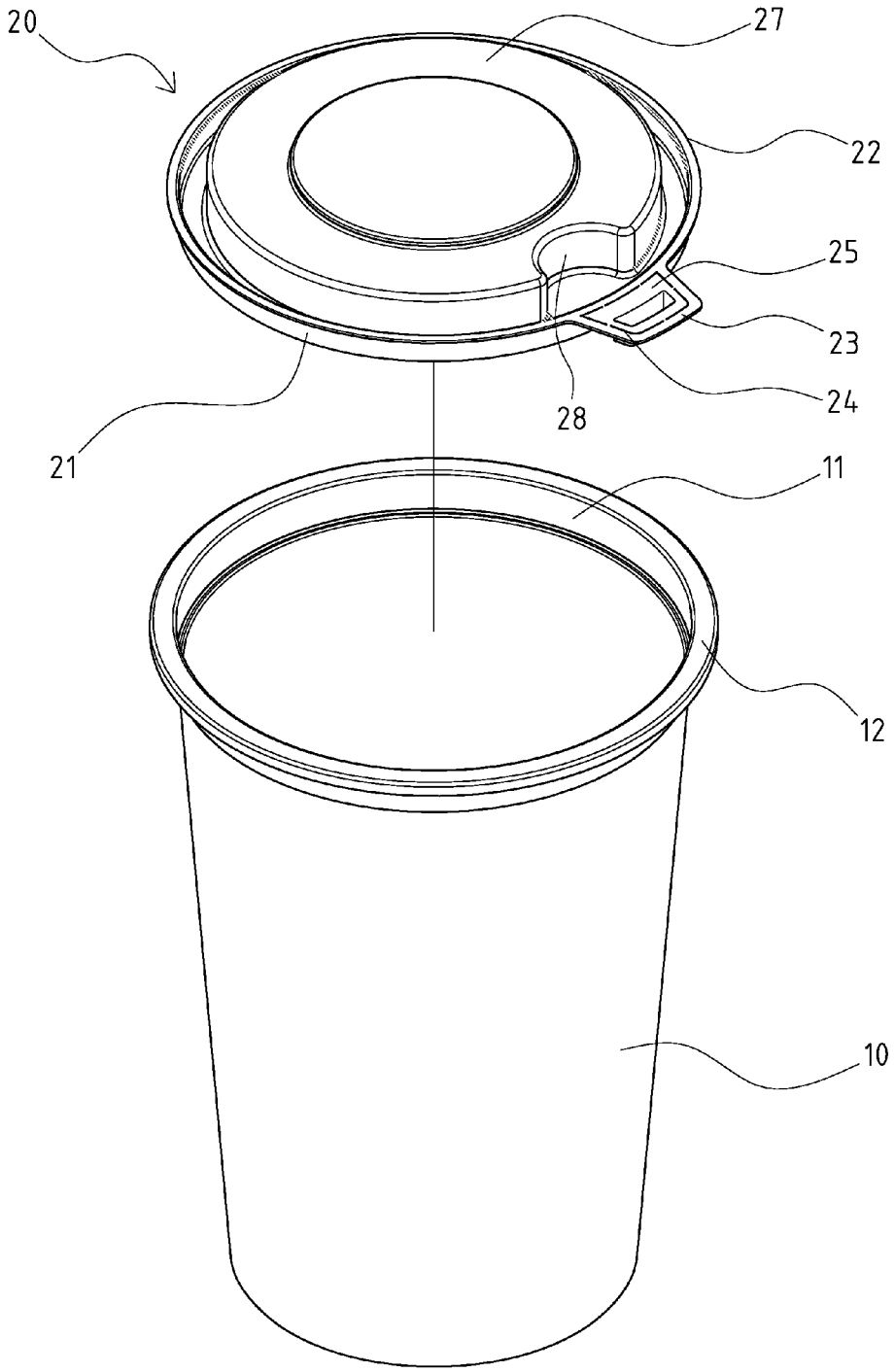
FIG. 2 is an exploded perspective view of the container in FIG. 1.
Figure 3:
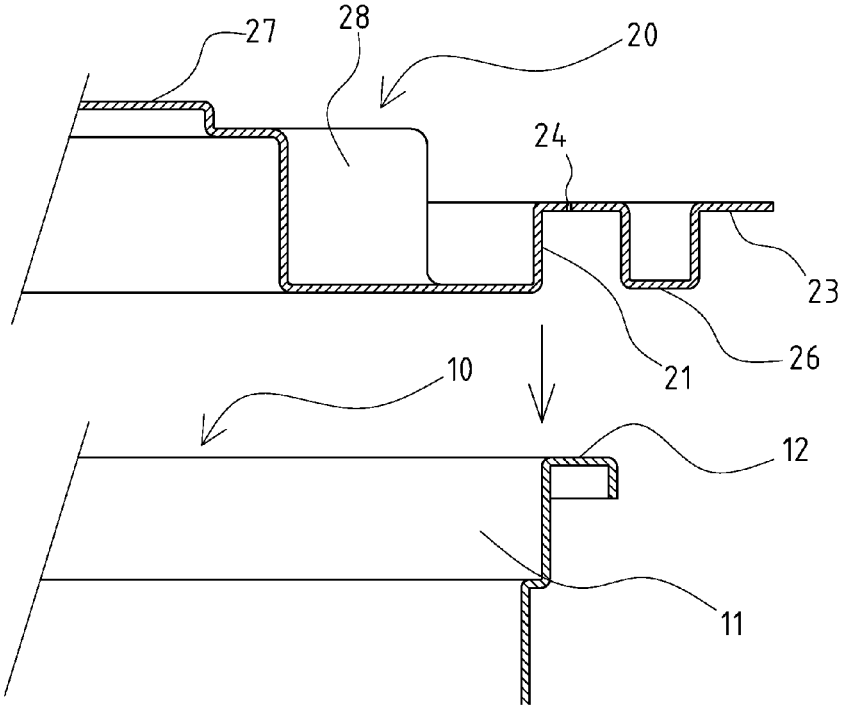
FIG. 3 is a partially cross-sectional view of the container in FIG. 1 when the cover is detached from the containing structure in accordance with the present invention.

Referring to the drawings and initially to FIGS. 1-6, a container, which prevents an illegal operation and can be easily identified after being illegally operated, in accordance with the present invention comprises a containing structure 10 and a cover 20 selectively water-tightly mounted on to the containing structure 10 for closing the containing structure 10. In the preferred embodiment of the present invention, the containing structure 10 is a cup-shaped structure.

The containing structure 10 has a hollow structure and has an opening for inputting objects, such as candies, cookies or fresh food, into the containing structure 10. The containing structure 10 includes an annular groove 11 defined in an inner periphery of the opening and an annular lip 12 radially extending from a distal edge of the opening. In the preferred embodiment of the present invention, the annular lip 12 horizontally and radially extends from the distal edge of the opening.

Figure 4:
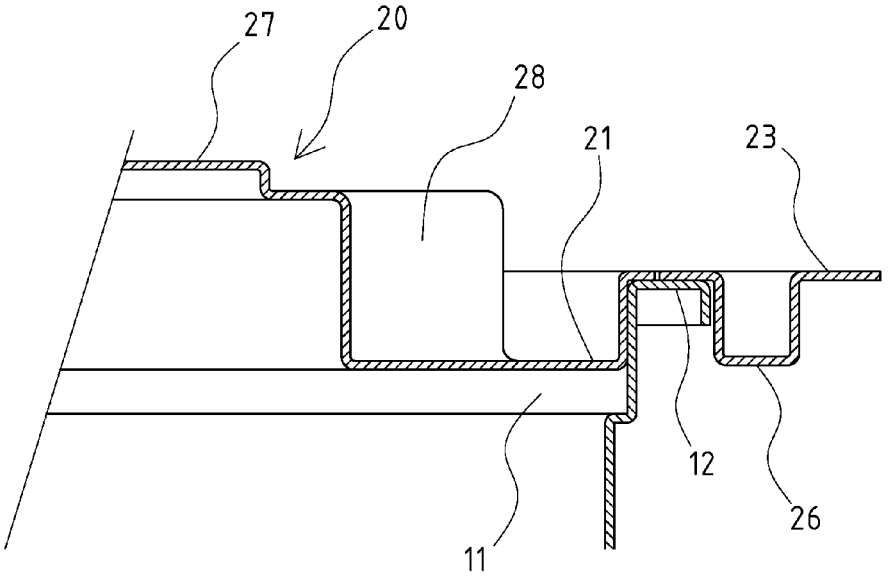
FIG. 4 is a partially cross-sectional view of the container in FIG. 1 along the tongue extending from the cover.
Figure 5:
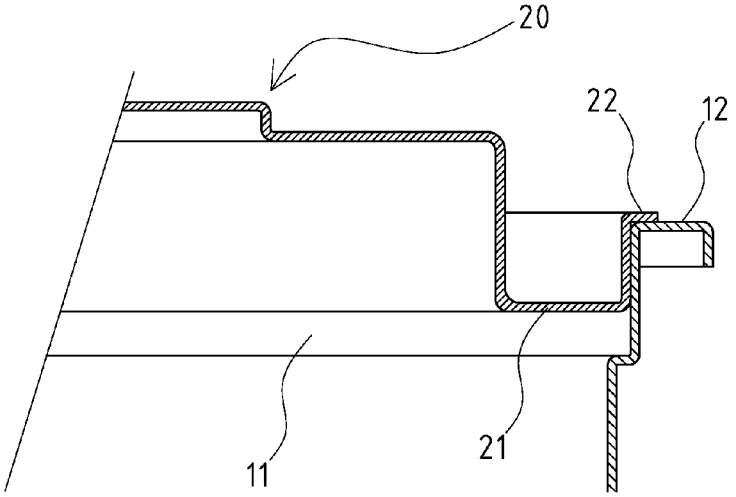
FIG. 5 is another partially cross-sectional view of the container in FIG. 1.
Figure 6:
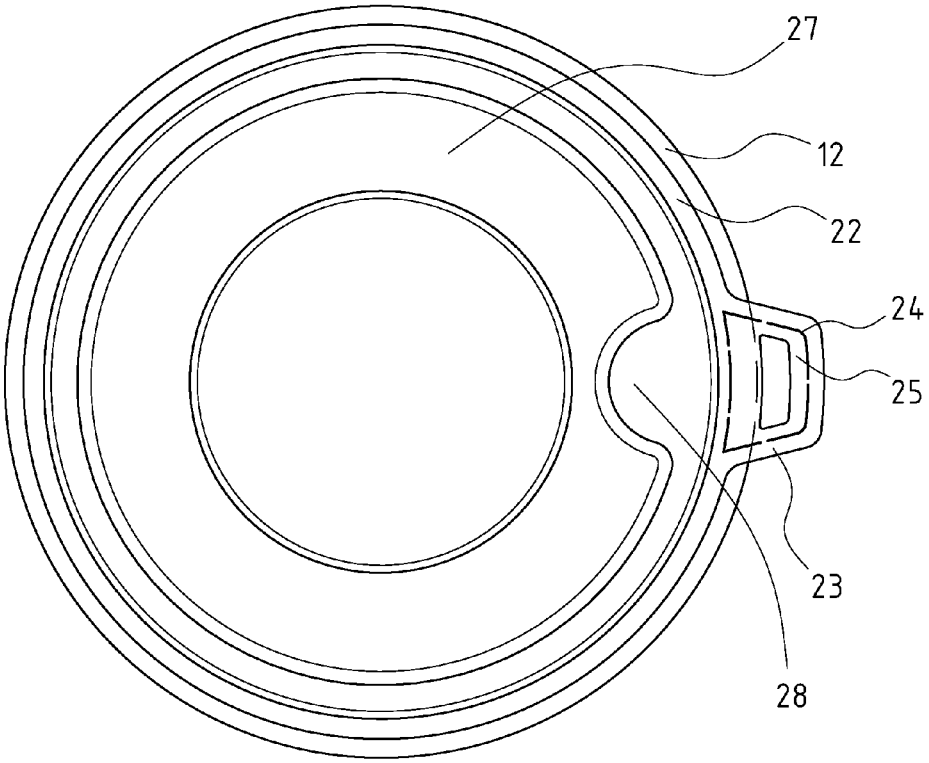
FIG. 6 is a top plan view of the container in FIG. 1.

The cover 20 includes an annular rib 21 formed on a bottom thereof and a flange 22 radially extending from a periphery of the cover 20, wherein the flange 22 has an outer diameter smaller than that of the annular lip 12 and a width being limited, for example, to smaller than a fingertip of a human's forefinger. With reference to FIG. 4, the annular rib 21 is water-tightly and partially received in the annular groove 11 and the flange 22 abuts against the annular lip 12 when the cover 20 water-tightly closes an opening of the containing structure 10. A tongue 23 extends from the flange 22 and a pre-broken line 24 is formed on the tongue 23, wherein the pre-broken line 24 encircles a pre-broken portion 25 and a stopper 26 is formed on a bottom of the pre-broken portion 25. The pre-broken portion 25 partially abuts against the annular lip 12, the stopper 26 is disposed along a distal edge of the annular lip 12, and a distance between the free end of the tongue 23 and the stopper 26 is limited, for example, to a distance between the free end of the tongue 23 and that the stopper 26 is smaller than that of a fingertip of a human's forefinger. The tongue 23 forms a griphook for user to easily detach the cover 20 from the containing structure 10 when the pre-broken portion 25 is detached from the tongue 23 along the pre-broken line 24. The cover 20 is centrally formed with a raised portion 27 and a concave portion 28 is defined in the raised portion 27 and, wherein the concave portion 28 radially corresponds to the tongue 23 and the raised portion 27 is hollow.

With reference to FIGS. 3, 4, 5 and 6, the annular rib 21 is water-tightly and partially received in the annular groove 11 and the flange 22 abuts against the annular lip 12 when the cover 20 water-tightly closes the opening in the containing structure 10. The unexpected customer usually intends to illegal open the container in accordance by the methods of digging out the flange 22 by fingernail, holding the flange 22 between thumb and forefinger or lifting the tongue 23 by thumb and forefinger. However, all the three ways cannot smoothly open the cover 20 that water-tightly closes the containing structure 10.

Figure 7:
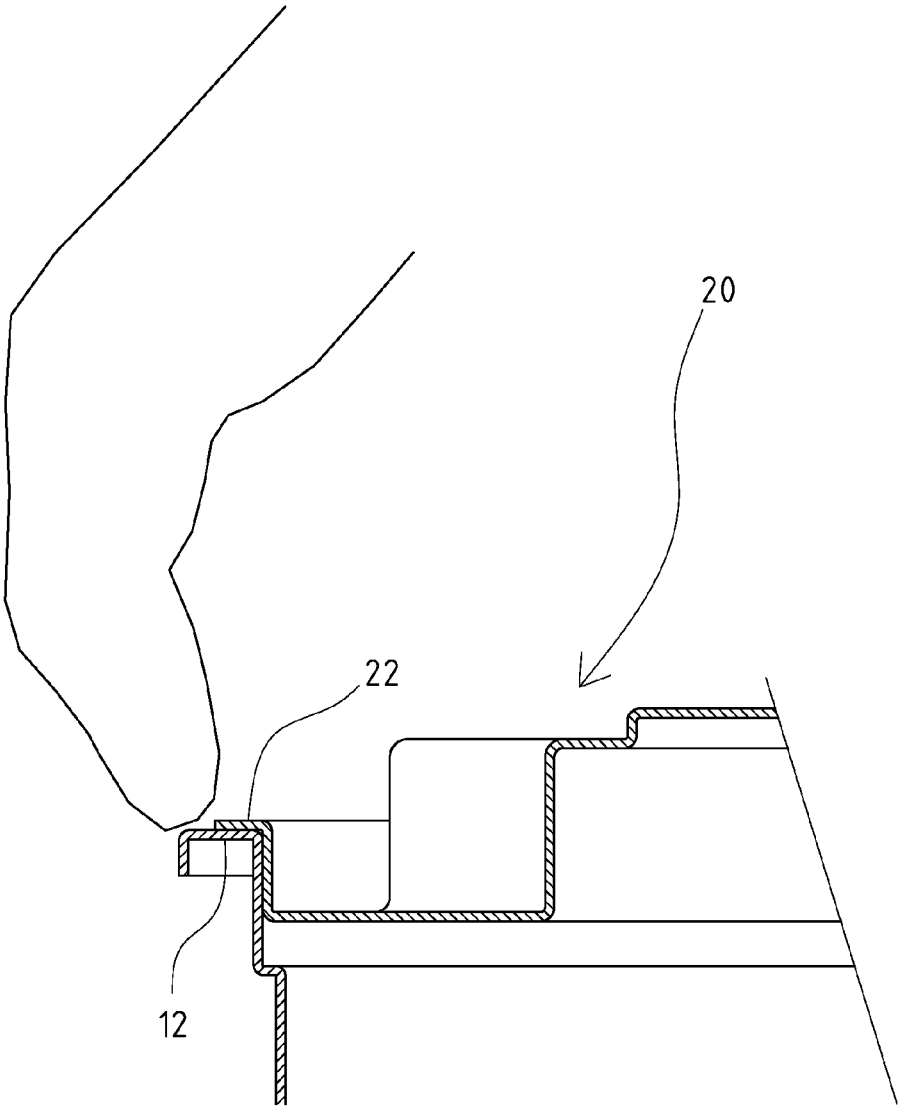
FIG. 7 is a first operational view of the container in FIG. 1.
Figure 8:
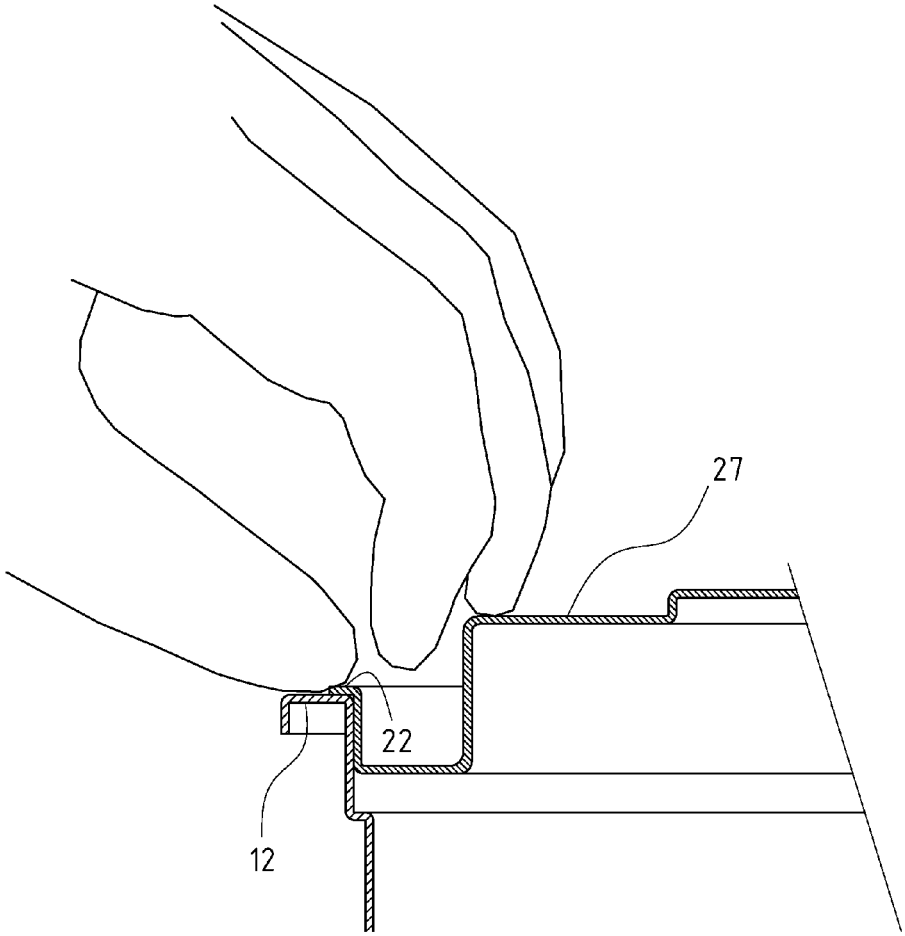
FIG. 8 is a second operational view of the container in FIG. 1.
Figure 9:
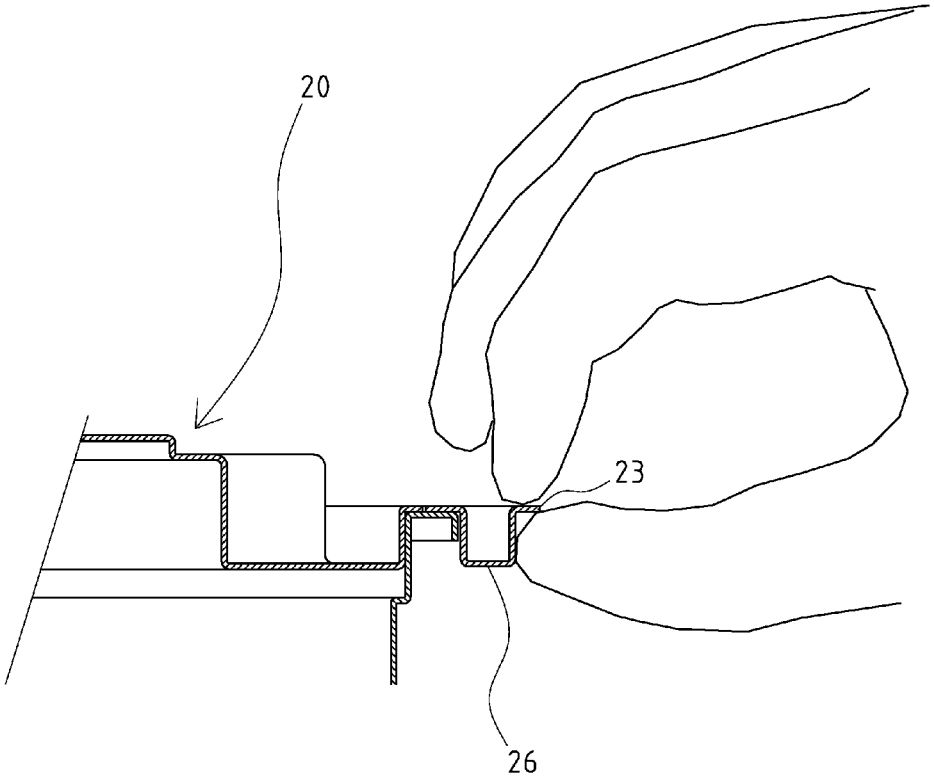
FIG. 9 is a third operational view of the container in FIG. 1.
Figure 10:
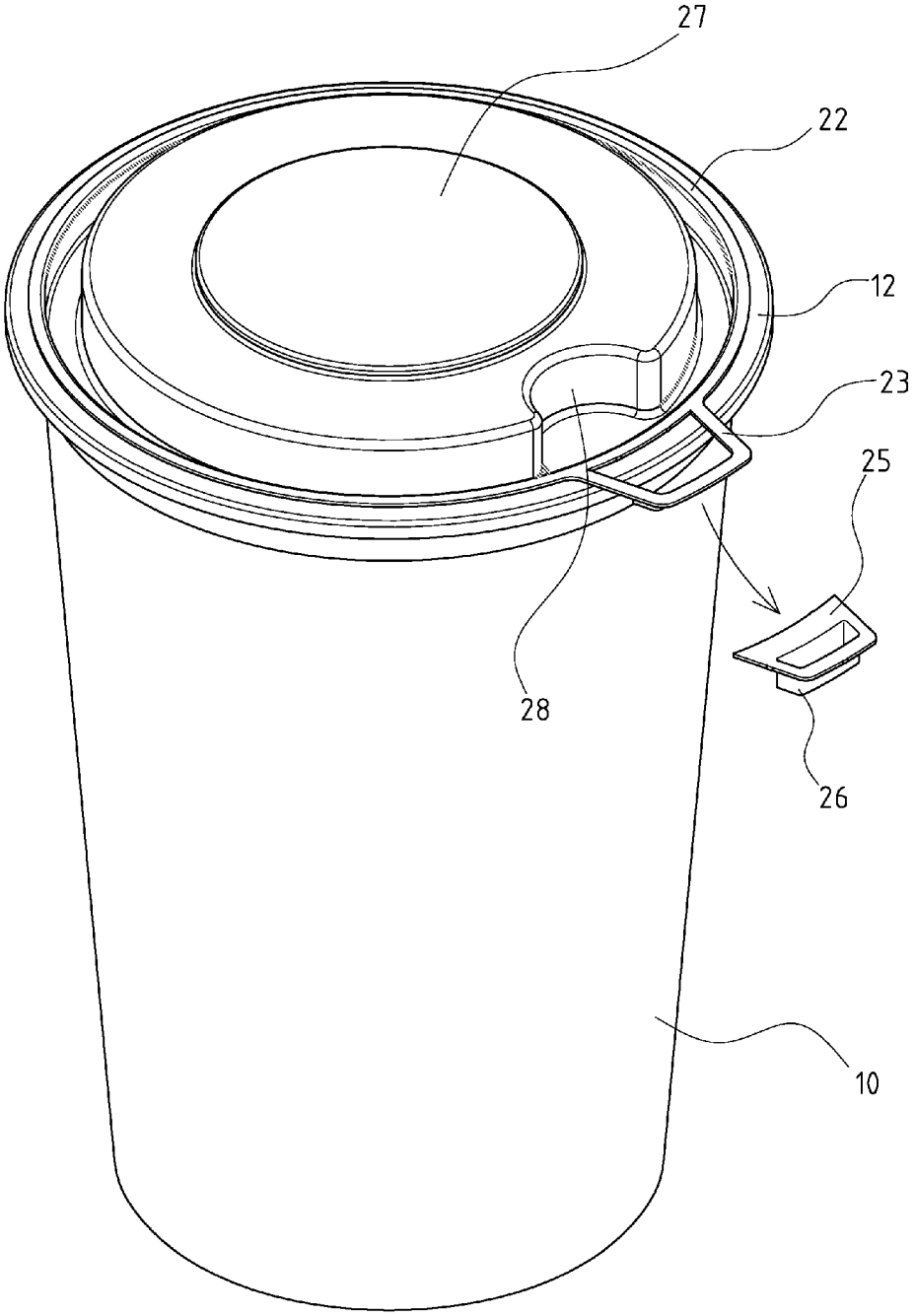
FIG. 10 is perspective view of the container in FIG. 1 when the broken portion is detached from the tongue.
Figure 11:
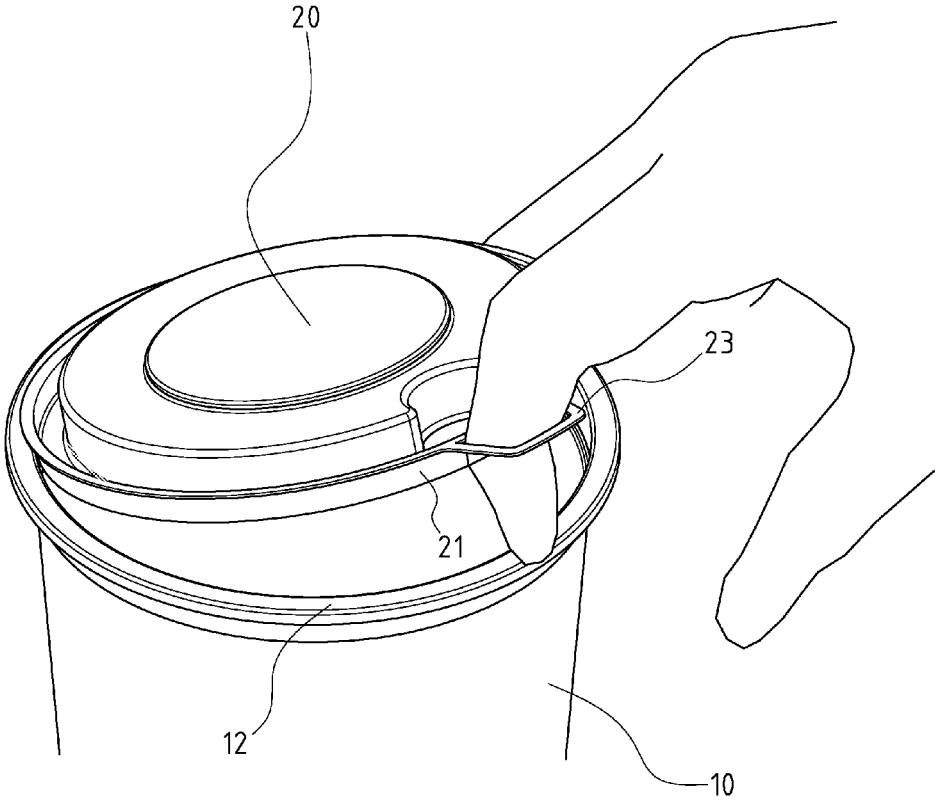
FIG. 11 is a forth operational view of the container in FIG. 1.

With reference to FIG. 7, when a thief, for example, wants to dig out the flange 22 with his or her fingernail, the flange 22 is slightly lifted and the thief s fingernail immediately disengages from the flange 22 when the flange 22 is lifted because the diameter of the flange 22 is smaller than that of the annular lip 12 and the width of the flange 22 is limited, and the flange 22 immediately abuts against the annular lip 12 when the thief s fingernail immediately disengages from the flange 22 such that the thief is failed to illegally open the container in accordance with the present invention. With reference to FIG. 8, the thief, for example, cannot find a suitable biasing point to open the cover 20 when holding the flange 22 between two fingers because the width of the flange 22 is limited, the raised portion 27 of the cover 20 stops the fingers of the thief and the flange 22 closely abuts against the annular lip 12. With reference to FIG. 9, when the thief, for example, wants to open the cover 20 by lifting the tongue 23, the fingertips of the thumb and forefinger of the thief will be kept out by the stopper 26 and cannot stably pinch the tongue 23 between two fingertips because the distance between the free end of the tongue 23 and the stopper 26 is smaller than that of a fingertip of a human's forefinger. As described above, an unexpected customer hardly opens the container of the present invention by an illegal method and the salesperson will easily perceive the strange movement and stop the illegal movement, immediately, for reducing the theft rate of commodities or foods on the shelf.

The stopper 26 is disposed along a distal edge of the annular lip 12 such that the thief cannot force open the cover 20 by using a tool extending to a bottom of the tongue 23. Furthermore, the pre-broken portion 25 is partially covered on the annular lip 12 of the containing structure 10 such that the pre-broken line 24 on the annular lip 12 is torn when the tool extending to flange 22.

The customer can press the pre-broken portion 25 and the pre-broken portion 25 will be detached from the tongue 23 along the pre-broken line 24 and the tongue 23 forms a griphook for user to easily detach the cover 20 from the containing structure 10 after paying money. The pre-broken line 25 is an irreversible structure such that the salesperson can easily identify the opened container of the present invention by watching the pre-broken line 24. The container with the food therein will be replaced for maintaining the fresh food and goodwill when the pre-broken line 24 is not complete.

Figure 12:
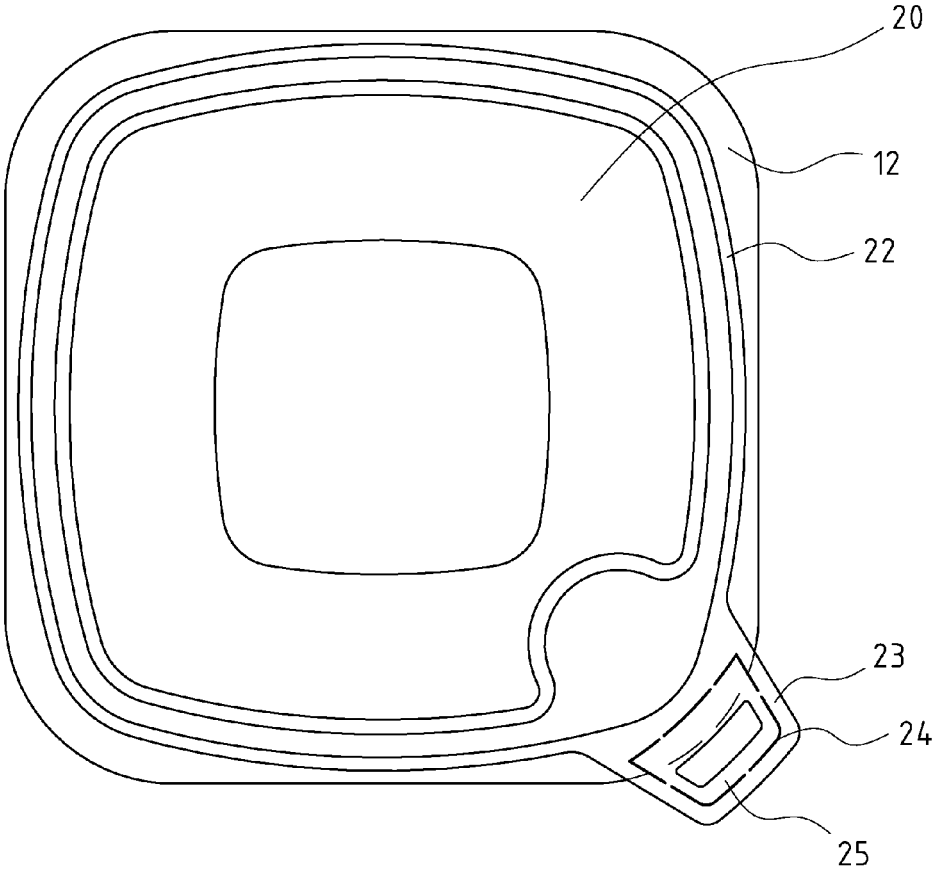
FIG. 12 is a top plan view of a second embodiment of a container in accordance with the present invention.

With reference to FIG. 12 that shows a second embodiment of the container in accordance with the present invention, in this embodiment, the containing structure 10 and the cover 20 respectively have a rectangle top plan view.

As described above, container that prevents from an illegal operation and can be easily identified after being illegally operated, in accordance with the present invention includes the following advantages.

1. The flange extending from the cover abuts against the annular lip of the containing structure and the width of the flange is smaller than that of a human's fingertip such that a thief cannot illegal detached the cover from the containing structure.
2. The thief cannot hold the flange of the between two fingers because the raised portion 27 of the cover 20 stops the fingers of the thief such that a thief cannot illegal detached the cover from the containing structure.
3. A stopper is formed on a bottom of the pre-broken portion and the distance between the free end of the tongue and the stopper is smaller than that of a human's fingertip such that the thief is hard to find a biasing point on the flange when holding the free end of the tongue between two fingers and the thief s fingertips will slip from the tongue due to the distance between the free end of the tongue and the stopper.
4. The stopper is disposed along a distal edge of the annular lip such that the thief cannot forced to open the cover by using a tool extending to a bottom of the tongue. Furthermore, the pre-broken portion is partially covered on the annular lip of the containing structure such that the pre-broken line on the annular lip is torn when the tool extending to flange.

Although the invention has been explained in relation to its preferred embodiment, it is to be understood that many other possible modifications and variations can be made without departing from the spirit and scope of the invention as hereinafter claimed.

I claim:

1. A container that prevents from an illegal operation and can be easily identified after being illegally operated, the container comprising:

a containing structure defining an opening for inputting objects therein and having an annular lip radially extending from a distal edge of the opening; and a cover selectively water-tightly mounted on to the containing structure for closing the containing structure, the cover including an annular rib formed on a bottom thereof and a flange radially extending from the periphery of the cover, wherein the flange has an outer diameter smaller than that of the annular lip and a width that is minimal to prevent the cover from the illegal operation, the annular rib water-tightly and partially received in the opening and the flange abuts against the annular lip when the cover water-tightly closes the opening in the containing structure, a tongue extending from the flange and a pre-broken line formed on the tongue, wherein the pre-broken line encircles a pre-broken portion and a stopper is formed on a bottom of the pre-broken portion, the pre-broken portion partially abutting against the annular lip, the stopper disposed along a distal edge of the annular lip of the containing structure and a distance between a free end of the tongue being minimal, the cover having a central portion centrally formed therein, wherein a thief cannot find a suitable biasing point so as to open the cover when holding the flange with two fingers because the width of the flange is minimal and such that the raised portion of the cover stops the fingers of the thief and the flange closely abuts against the annular lip, the tongue forming a griphook for a user to easily detach the cover from the containing structure when the pre-broken portion is detached from the tongue along the pre-broken line.

2. The container of claim 1, wherein the containing structure includes an annular groove defined in an inner periphery of the opening for partially receiving the annular rib of the cover when the cover water-tightly closing the containing structure.

3. The container of claim 1, wherein the cover has a concave portion is defined in the raised portion, the concave portion radially corresponding to the tongue, wherein the raised portion is hollow.

* * * * *